US011084674B2

(12) United States Patent
Seki

(10) Patent No.: US 11,084,674 B2
(45) Date of Patent: Aug. 10, 2021

(54) PAPER SHEET PROCESSING APPARATUS AND PAPER SHEET PROCESSING METHOD

(71) Applicants: Kabushiki Kaisha Toshiba, Tokyo (JP); Toshiba Infrastructure Systems & Solutions Corporation, Kawasaki (JP)

(72) Inventor: Atsushi Seki, Kanagawa (JP)

(73) Assignees: Kabushiki Kaisha Toshiba, Tokyo (JP); Toshiba Infrastructure Systems & Solutions Corporation, Kawasaki (JP)

( * ) Notice: Subject to any disclaimer, the term of this patent is extended or adjusted under 35 U.S.C. 154(b) by 6 days.

(21) Appl. No.: 16/706,231

(22) Filed: Dec. 6, 2019

(65) Prior Publication Data

US 2020/0299082 A1 Sep. 24, 2020

(30) Foreign Application Priority Data

Mar. 19, 2019 (JP) ..... JP2019-051253

(51) Int. Cl.

*B65H 5/02* (2006.01)
*B65H 7/20* (2006.01)
*B65H 43/08* (2006.01)

(52) U.S. Cl.

CPC ..... *B65H 5/021* (2013.01); *B65H 7/20* (2013.01); *B65H 43/08* (2013.01); *B65H 2511/512* (2013.01); *B65H 2515/60* (2013.01); *B65H 2515/84* (2013.01); *B65H 2515/842* (2013.01); *B65H 2553/42* (2013.01); *B65H 2557/652* (2013.01); *B65H 2701/1912* (2013.01)

(58) Field of Classification Search

CPC ..... B65H 2557/652; B65H 2515/842; B65H 5/021; B65H 2553/42

See application file for complete search history.

(56) References Cited

U.S. PATENT DOCUMENTS 6,979,815 B2 * 12/2005 Duhamel ..... B65H 20/06 198/810.02
7,624,857 B2 * 12/2009 Kusel ..... B65G 43/02 198/502.4
2009/0208065 A1 8/2009 Miura et al.

FOREIGN PATENT DOCUMENTS

| | | | |
|---|---|---|---|
| JP | H09-309642 | A | 12/1997 |
| JP | 2002-179285 | A | 6/2002 |
| JP | 2007-066059 | A | 3/2007 |
| JP | 2009-199182 | A | 9/2009 |
| WO | 2018/042915 | A1 | 3/2018 |

* cited by examiner

*Primary Examiner* — Jeremy R Severson
(74) *Attorney, Agent, or Firm* — Baker Bott L.L.P.

(57) ABSTRACT

According to one embodiment, a paper sheet processing apparatus includes a conveyance device with a conveyor belt, and an inspection device configured to inspect a paper sheet conveyed by the conveyor belt. The inspection device includes an image detection device configured to capture an image of the paper sheet and the conveyor belt and obtain an image of the paper sheet and the conveyor belt, an image processing device configured to detect a degradation level of the conveyor belt based on an belt image of the conveyor belt, and a controller configured to transmit information encouraging replacement of the conveyor belt to a monitor.

12 Claims, 6 Drawing Sheets

PAPER SHEET PROCESSING APPARATUS AND PAPER SHEET PROCESSING METHOD

CROSS-REFERENCE TO RELATED APPLICATIONS

This application is based upon and claims the benefit of priority from Japanese Patent Application No. 2019-051253, filed Mar. 19, 2019, the entire contents of which are incorporated herein by reference.

FIELD

Embodiments described herein relate generally to a paper sheet processing apparatus and a paper sheet processing method of processing a paper sheet.

BACKGROUND

Recently, a large number of bills (banknotes) have been used on a daily basis in banks, large-scale retail stores, etc., and have been sorted according to their types and whether they are normal or damaged (the uncleanness and damage to bills). As apparatuses for automating this operation to sort bills, paper sheet processing apparatuses have been used. A paper sheet processing apparatus comprises, for example, an inspection section (inspecting device) which inspects each bill for the type and damage, a plurality of accumulation sections which accumulate bills according to their types, etc., and a conveyance mechanism which conveys bills through a predetermined path.

The inspection section comprises an image reading device which obtains an image of each bill conveyed by the conveyance mechanism, a fluorescence detection device which detects fluorescent printing of each bill, and other various sensors. The image reading device detects the type, uncleanness, skew, etc., of each bill from a read image.

Generally, the conveyance mechanism comprises a conveyor belt, a conveyance roller, a conveyance guide, etc., and conveys bills or media at high speed. At this time, each bill is conveyed in a state where it is on the conveyor belt or in a state where it is held between conveyor belts facing each other. In the inspection section, to perform correct detection, each bill needs to be stably conveyed to a predetermined position at a predetermined speed by the conveyance mechanism.

In the above paper sheet processing apparatus, as the belt and rubber roller of the conveyance mechanism are essential to the stable conveyance and the maintenance of detection performance, they are periodically replaced as periodical replacement parts. However, in some cases, as the belt or rubber roller is degraded or stretched before replacement, bills cannot be stably conveyed (the belt is deviated). Thus, inspection may not be correctly performed. To the contrary, although the belt or rubber roller can be still used, it may be replaced more than necessity.

DETAILED DESCRIPTION

Figure 1:
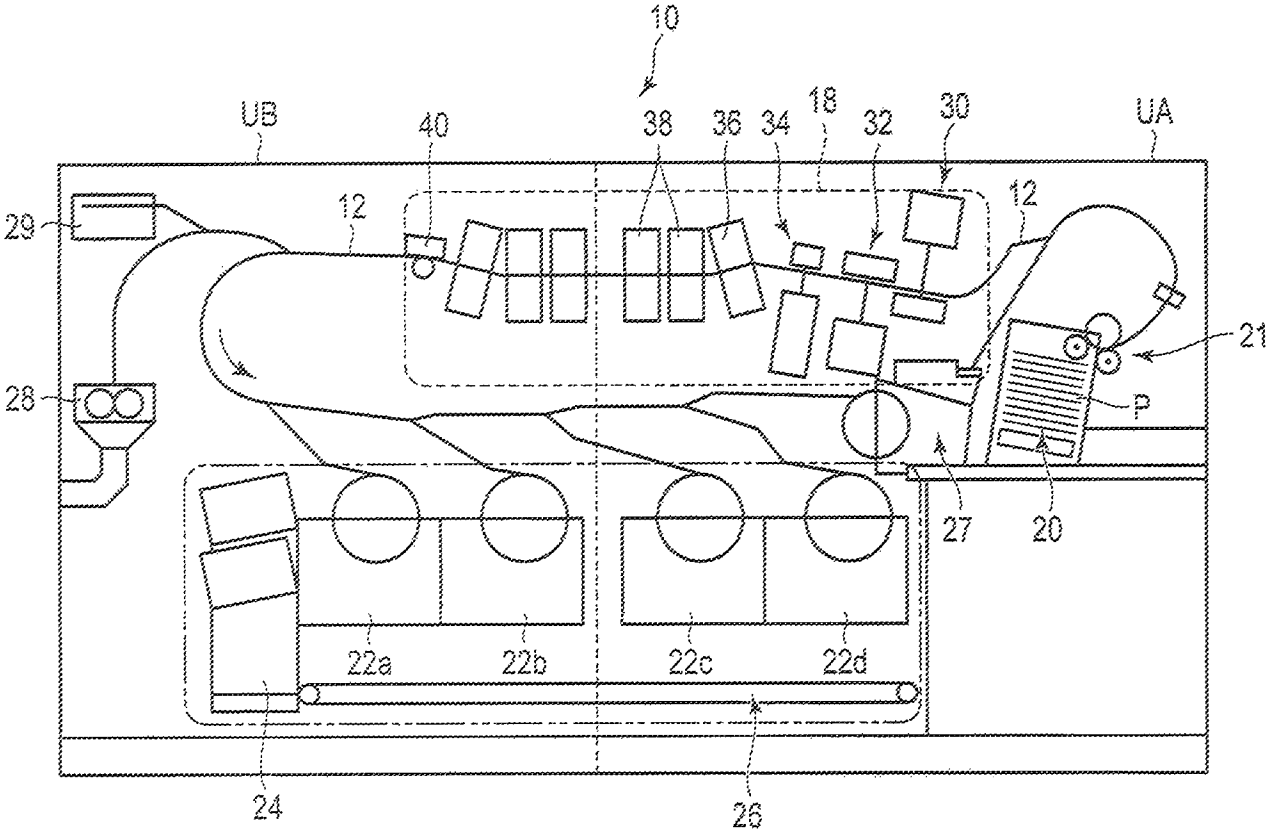
FIG. 1 is a cross-sectional view schematically showing the overall structure of a paper sheet processing apparatus according to an embodiment.

Various embodiments will be described hereinafter with reference to the accompanying drawings.

In general, according to one embodiment, a paper sheet processing apparatus comprises a conveyance device comprising a conveyor belt extending along a conveyance path and configured to convey a paper sheet by the conveyor belt; and an inspection device configured to inspect the paper sheet conveyed by the conveyor belt based on an image of the paper sheet. The inspection device comprises an image detection device configured to capture an image of the paper sheet conveyed by the conveyor belt and an image of the conveyor belt and obtain an image of the paper sheet and the conveyor belt; an image processing device configured to detect a degradation level of the conveyor belt based on an belt image of the conveyor belt in the obtained image; and a controller configured to transmit information encouraging replacement of the conveyor belt to a monitor mounted on or connected to the inspection device in accordance with the detected degradation level.

The disclosure is merely an example, and proper changes within the spirit of the invention, which are easily conceivable by a skilled person, are included in the scope of the invention as a matter of course. In addition, in some cases, in order to make the description clearer, the widths, thicknesses, shapes and the like, of the respective parts are illustrated schematically in the drawings, rather than as an accurate representation of what is implemented. However, such schematic illustration is merely exemplary, and in no way restricts the interpretation of the invention. In addition, in the specification and drawings, the same elements as those described in connection with preceding drawings are denoted by like reference numbers, and detailed description thereof is omitted unless necessary.

EMBODIMENT

FIG. 1 is a cross-sectional view schematically showing the inner structure of a bill processing apparatus according to an embodiment, as an example of a paper sheet processing apparatus. As shown in FIG. 1, the bill processing apparatus 10 comprises a first module UA and a second module UB, The first module UA and the second module UB are mechanically and electrically connected to each other. The bill processing apparatus 10 comprises a plurality of conveyance paths 12 extending through the first module UA and the second module UB, a supply device 20 in which bills P to be processed are stacked, and a pick-up device 21 which picks up the bills P one by one from the supply device 20 and sends them to the conveyance paths 12. The conveyance paths 12 are defined by a plurality of guide plates (not shown), a plurality of gates (not shown), a plurality of conveyor belts (described later), and the like. The bill processing apparatus 10 comprises a conveyance mechanism (conveyance device) which conveys a plurality of bills in series along the conveyance paths 12. The conveyance mechanism comprises endless conveyor belts. conveyance rollers, a drive motor which drives the conveyor rollers, adhesion devices, sensors which detect, the passage of paper sheets, etc., as described later.

The bill processing apparatus 10 comprises an inspection module (inspection device) 18 which inspects the conveyed bills P one by one, a plurality of accumulation/binding devices 22*a*, 22*b*, 22*c* and 22*d* which accumulate and bind the bills based on the types, a discharge conveyance mechanism 26 which is provided under the accumulation/binding devices 22*a* to 22*d* and conveys the paper sheet bundles bound by the binding devices to a discharge section 24, a rejected bill discharge section 27 which collects rejected bills, a cutting device 28 which cuts rejected bills, and a batch card discharge section 29 which collects batch cards. It should be noted that a batch card is a card to be loaded into the device together with a paper sheet bundle, and is a card to which a barcode, QR (registered trademark) code or the like indicating information concerning the paper sheet bundle is attached.

The inspection device 18 inspects the delivered bills P by detecting their types, shapes, thicknesses, sides and authenticity (genuine/counterfeit), whether they are normal or damaged, two overlapped sheets, etc., and comprises various types of sensors for these detection, an image capture device, etc. For example, the inspection device 16 comprises a first image detection device 30 which detects the reflection image information of the upper surface of each bill P, a second image detection device 32 which detects the reflection image information of the lower surface of each bill P, a transparent image detection module 34 which detects the transparent image information of each bill P, a magnetic sensor 36 which detects the magnetic printing property of each bill P, a fluorescence detection module 38 which detects the bleaching light emitting property and fluorescence printing information of each bill P, and a thickness detection module 40 which detects the thickness of each bill P and detects a tape and a plurality of overlapped sheets. The inspection device 18 inspects each bill P for the type, shape, thickness, side and authenticity, whether it is normal or damaged, the uncleanness and damage, two overlapped sheets, etc., based on the detection information of the above various detection devices and magnetic sensors.

The bill processing apparatus 10 comprises a function and device for detecting the degradation level of the structural elements of the conveyance mechanism, for example, the conveyer belts, through the use of a detection information of the detection devices or various sensors of the inspection device 18. For example, a detection module (detection device) which detects the degradation level is configured to detect the degradation level of the conveyor belts, using an obtained image of the first image detection device 30.

Figure 2:
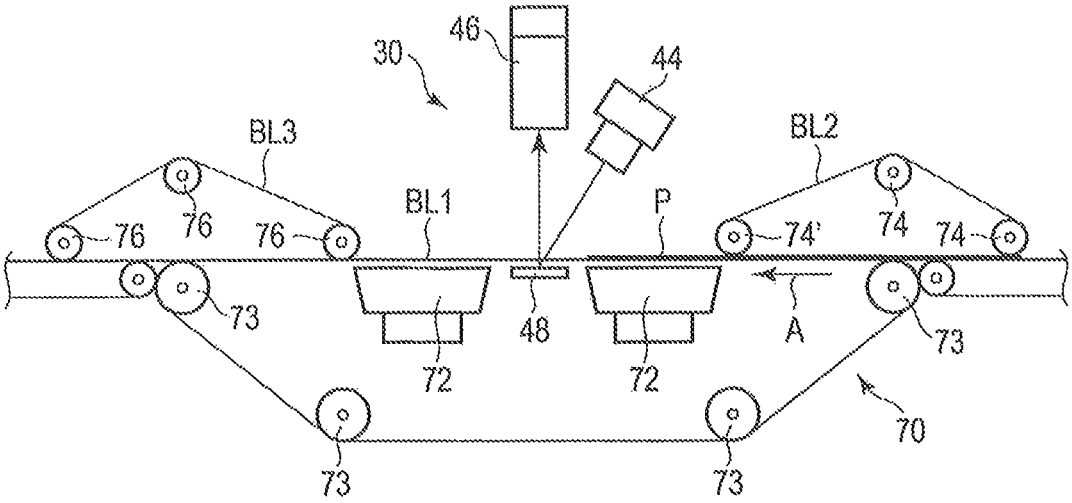
FIG. 2 is a side view schematically showing a conveyance mechanism and an Image detection device of the paper sheet processing apparatus.
Figure 3:
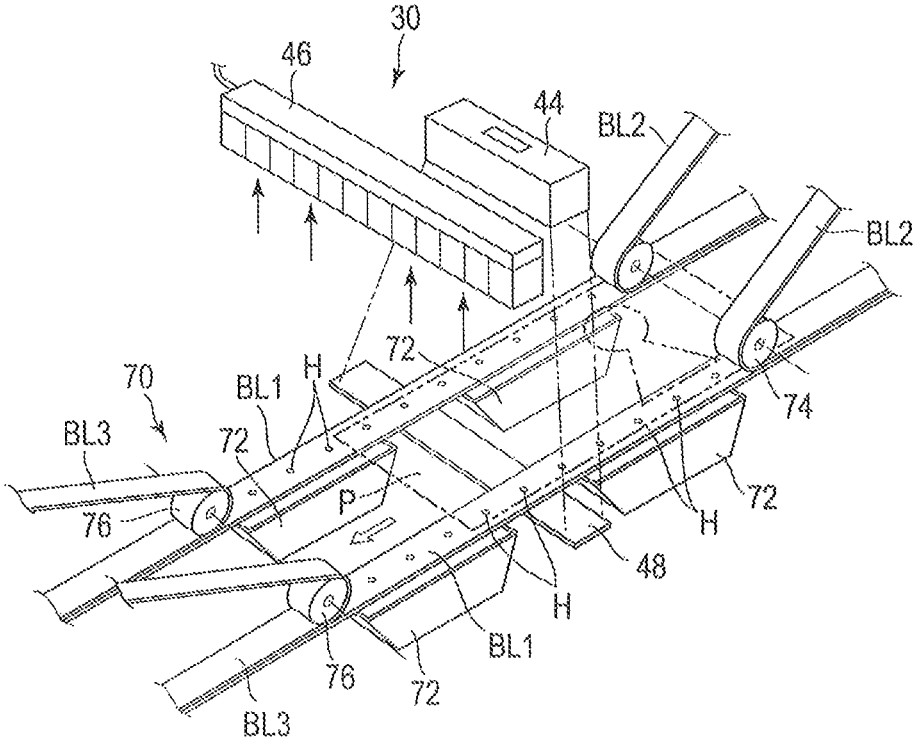
FIG. 3 is a perspective view schematically showing the conveyance mechanism and the image detection device.

FIG. 2 is a side view showing the first image detection device 30 and the conveyance mechanism. FIG. 3 is a perspective view showing the first image detection device and the conveyance mechanism.

As shown in the figures, the conveyance mechanism 70 comprises a pair of strip-shaped first conveyor belts BL1 formed of, for example, rubber, a pair of second conveyor belts BL2 facing the first conveyor belts BL1, a pair of third conveyor belts BL3 facing the first conveyor belts BL1, and a plurality of suction devices 72. Each of the first, conveyor belts BL1 is an endless belt which is looped over a plurality of pulleys 73. A predetermined length portion of each conveyor belt BL1 extends substantially in a horizontal fashion along the conveyance paths 12. The pair of first conveyor belts BL1 is arranged in parallel with each other and the distance between them is slightly less than the width of each bill P. The first conveyor belt BL1 has a plurality of suction holes H which are formed at predetermined intervals in a longitudinal direction in each first conveyor belt BL1 so as to penetrate the first conveyor belt BL1.

The second conveyor belts BL2 are provided on the upstream side of the first conveyor belts BL1 in a conveyance direction A. Each of the second conveyor belts BL2 is looped over a plurality of pulleys 74, and its predetermined length portion extends so as to face, in other words, overlap a corresponding first conveyor belt BL1.

The third conveyor belts BL3 are provided on the downstream side of the first conveyor belts BL1 in the conveyance direction A. Each of the third conveyor belts BL3 is looped over a plurality of pulleys 76, and its predetermined length portion extends so as to face, in other words, overlap a corresponding first conveyor belt BL1. The second conveyor belts BL2 and the third conveyor belts BL3 are provided such that the distance between them is greater than the length of each bill P in the conveyance direction A. On each first conveyor belt BL1, the area between the second conveyor belt BL2 and the third conveyor belt BL3 forms an inspection area.

The suction devices 72 are disposed to face the rear surfaces of the first conveyor belts BL1 between the second conveyor belt BL2 and the third conveyor belt BL3. The suction devices 72 have a function of causing each bill P to adhere to the upper surfaces of the first conveyor belts BL1 by sucking in air through the suction holes H of the first conveyor belts BL1.

Each bill P is conveyed in the conveyance direction A in a state where the both end portions in a width direction are inserted between the first conveyor belts BL1 and the second conveyor belts BL2. Subsequently, the bill P is conveyed via the inspection area by the first conveyor belts BL1 in a state where the both end portions in a width direction adhere to the upper surfaces of the first conveyor belts BL1. After passing the inspection area, the bill P is further conveyed in a state where it is inserted between the third conveyor belts BL3 and the first conveyor belts BL1.

The first image detection device 30 comprises, in the inspection area, an illumination device 44 and an image capture device 46 above the first conveyor belts BL1, and a white reference plate 48 under the first conveyor belts BL1. For example, the white reference plate 48 is formed in the shape of a rectangular plate, and is provided so as to be substantially perpendicular to the pair of first conveyor belts BL1. The both end portions of the white reference plate 48 in a longitudinal direction extend beyond the first conveyor belts BL1.

The angle at which the illumination device 44 is provided is set such that the illumination device 44 emits detection light to the upper surfaces of the pair of first conveyor belts BL1, the upper surface of each bill P passing the inspection area and the whole area of the white reference plate 48. The illumination device 44 comprises, as a light source, an LED array which is configured to emit visible light, near-ultraviolet light, or near-infrared light, depending on the intended use.

The image capture device 46 is provided at a position facing the white reference plate 48 across the intervening first conveyor belts BL1. The image capture device 46 is structured by, for example, a line image sensor (for example, a monochromatic line CCD or line CMOS) or a video camera, which captures an image of each conveyed bill P in series in a one-dimensional manner. In the present embodiment, a line image sensor is used as the image capture device 46. The line image sensor comprises a plurality of photodetectors (imaging elements or CCDs) which convert the received light into an electric signal, in other words, an image. The photodetectors are arranged in a plurality of lines in a direction substantially perpendicular to the conveyance direction A. The image capture device 46 obtains an image of the upper surface of each bill P and an image of the pair of first conveyor belts BL1 by capturing an image of a predetermined range (capture range) which the bill P passes in series by the photodetectors.

Figure 4:
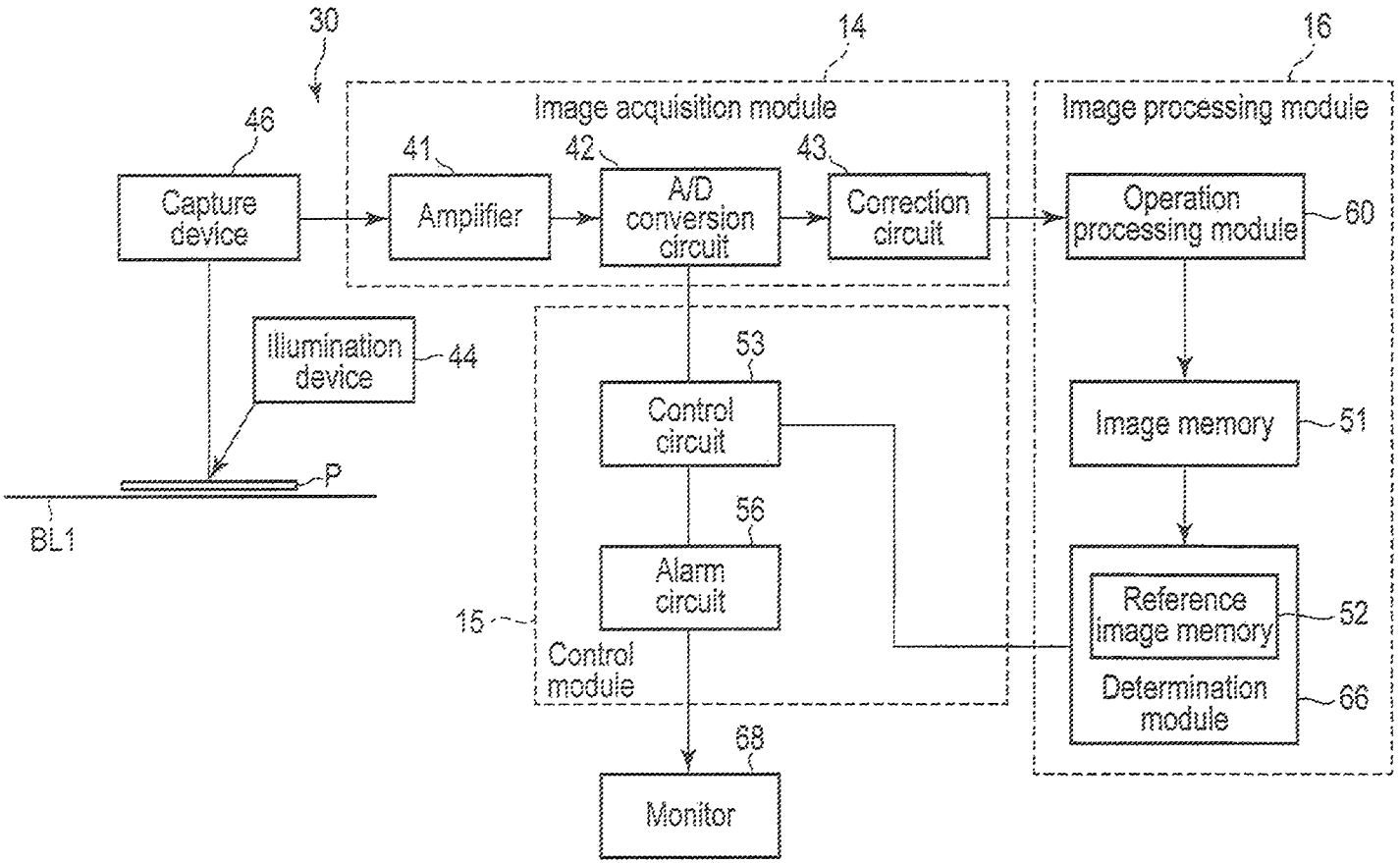
FIG. 4 is a block diagram showing image acquisition module, control module and image processing module of the image detection device as functional blocks.

FIG. 4 is a block diagram showing the functional blocks of the inspection device 18 and the first image detection device 30. As shown in FIG. 4, the inspection device 18 or the image detection device 30 comprises an image acquisition module 14 which obtains an image captured by the image capture device 46, an image processing module 16 comprising software and configured to process an obtained image or configured to process an obtained image based on software, and a control module 15.

The image acquisition module 14 comprises an amplifier 41, an analog/digital conversion circuit (A/D conversion circuit) 42, and a correction circuit 43. The amplifier 41 amplifies an output signal (image data) of the image capture device (line image sensor) 46 and outputs the signal. The A/D conversion circuit 42 converts an analog signal as an input, signal into a digital signal and outputs the digital signal as an output signal. The correction circuit 43 corrects the ununiformity of an input signal based on the characteristics of each imaging element of the image capture device 46 stored in advance. The correction circuit 43 performs the sensitivity correction of the image capture device 46 such that, of the output signal received from the image capture device 46, the luminance of pixels corresponding to the image of the white reference plate 48 is specified luminance.

The image processing module 16 comprises an operation processing module (an arithmetical processor) 60, an image memory 51 in which image data obtained by an operation process is accumulated and stored, and a determination module 66 comprising a reference image memory 52 in which reference image data is stored. The operation processing module 60 performs the detection of positions and skew, the correction of positions and skew and the operation of the amount of characteristics of an obtained image based on firmware, and transmits the image data obtained by the operation process to the image memory 51.

In the reference image memory 52 of the determination module 66, a plurality of reference image data items are stored in advance for each type of bills P as the criteria for various types of determination of the bills. In the reference image memory 52, a first threshold A and a second threshold B are stored. The first threshold A is the threshold of the luminance of a belt image and is used as the criterion for the degradation level of the first conveyor belts BL1. The second threshold B is used as the criterion for the gap width of the conveyor belts BL1. The determination module 66 determines, for example, the type and uncleanness of each bill P by comparing the image data read from the image memory 51 with the reference image data stored in the reference image memory 52. In the present embodiment, the determination module 66 determines the degradation level of the first conveyor belts BL1 by detecting, of the image data, an image (belt image) of each first conveyor belt. BL1 and comparing the belt images with the reference image data stored in the reference image memory 52. For example, the determination module 66 determines the degradation level of the first conveyor belts BL1 by detecting the luminance of each belt image and comparing the detected luminance of each belt image with the first threshold A stored in the reference image memory 52. Further, the determination module 66 determines the degradation level of the first conveyor belts BL1 by detecting the gap width in the width direction of each belt image and comparing the detected gap width with the second threshold B stored in the reference image memory 52. The determination module 66 transmits the result of determination to the control module 15.

As described above, the image processing module 16 including the determination module 66 structures an image degradation determination device for determining the degradation of the conveyance belts.

The control module 15 comprises a control circuit 53 and an alarm circuit 56. The control circuit 53 performs integrated control for the image capture device 46, the illumination device 44, the image acquisition module 14 and the image processing module 16. For example, the control circuit 53 controls the time when the image capture device 46 captures an image of the capture range. Further, the control circuit 53 obtains the time of replacement of the conveyor belts based on the result of determination transmitted from the image processing module 16, in other words, based on the degradation level of the conveyance belts. The control circuit 53 transmits an instruction to replace a belt to the alarm circuit 56 at the time of replacement of the belt. Based on this instruction, the alarm circuit 56 transmits information encouraging the replacement of the belt, for example, an alarm signal, to the monitor 68 of the bill processing apparatus 10. Accordingly, a belt replacement instruction is displayed on the monitor 68.

The alarm indication is not necessarily realized by displaying an instruction on the monitor. The alarm indication may be realized by, for example, lighting an alarm lamp or outputting an alarm sound.

Figure 5:
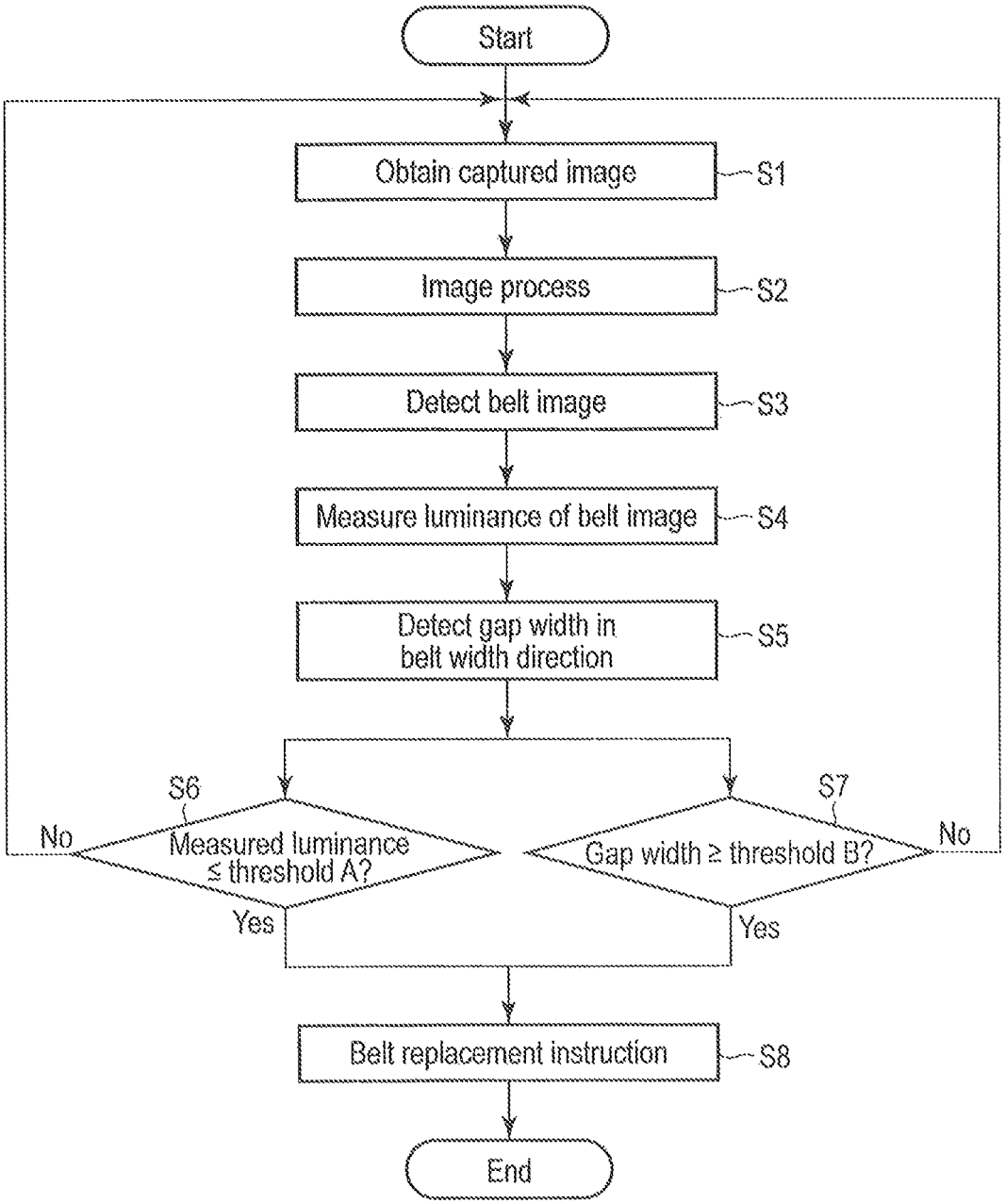
FIG. 5 is a flowchart showing a process for detecting the degradation level of each conveyor belt in the paper sheet processing apparatus.

Now, this specification explains the image capture operation and image detection operation by the first image detection device 30 and the inspection device 18 configured as described above. FIG. 5 is a flowchart showing the capture operation and the operation for detecting the degradation level of the first conveyor belts BL1 by the first image detection device 30 and the inspection device 18.

As shown in FIG. 5, the image detection device 30 captures and obtains images of a bill P and the first conveyor belts BL1 (step S1). In this case, as shown in FIG. 2 and FIG. 3, while the bill P conveyed by the conveyance mechanism 70 passes the inspection area of the image detection device 30, in other words, while the bill P passes the white reference plate 48, the illumination device 44 emits inspection light to the bill P, the first conveyor belts BL1 and the white reference plate 48, and the image capture device 46 receives the reflected light and captures an image of the reflected light. By amplifying and changing the output signal of the image capture device 46 by the image acquisition module 14, an image of the obverse side of the bill P and an image of the pair of first conveyor belts BL1 are obtained.

Figure 6:
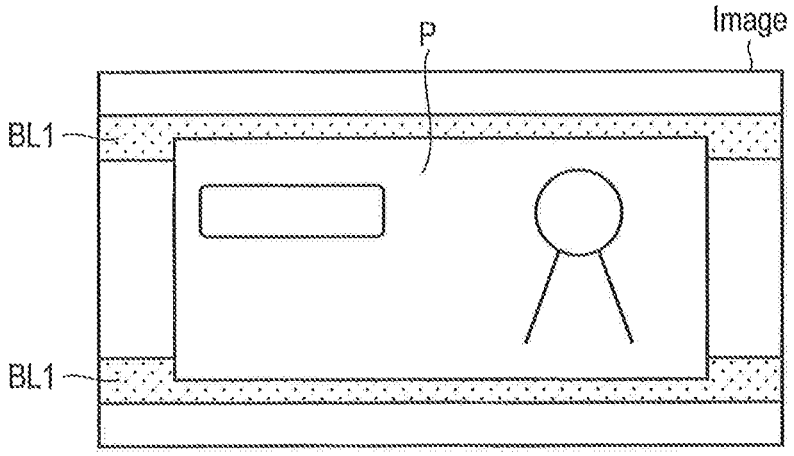
FIG. 6 is a plan view showing an example of an obtained image of the conveyor belts and a paper sheet.

FIG. 6 shows an example of an obtained image. As shown in the figure, the obtained image includes an image of the obverse side of the bill P and an image of the pair of first conveyor belts BL1. The image of the example shown in FIG. 6 is captured in a state where the bill P is not slid or skewed. As shown in the figure, the portion in which the bill P is not present on the white reference plate 48 is an obtained image by the reflected light on the white, reference plate 48, and is read as a bright image. Since the reflectance of the first conveyor belts BL1 is less than that of the white reference plate 48, the first conveyor belts BL1 are read as images slightly darker than the white reference plate 48.

As shown in FIG. 5, subsequently, the image processing module 16 applies an operation process to the obtained image (step S2). In an image process, the operation processing module 60 detects the position gap (slide) and skew of the obtained image of the bill P by detecting the boundary (outline) of the image of the bill P, in other words, the side edges (long sides and short sides) of the image of the bill P, and comparing the detected outline with the reference position stored in advance. The operation processing module 60 corrects the position and skew of the obtained image based on the detected position gap and skew of the bill P (affine transformation), in other words, corrects the image of the bill P such that the long sides and short sides of the bill P in the obtained image are matched with the reference position.

The determination module 66 compares the image in which the position and skew have been corrected with the reference images of paper sheets stored in the reference image memory 52, and for example, detects whether or not predetermined information is printed on the bill P of the image. In this way, the determination module 66 determines the type of the bill P and outputs the result of determination to the control module 15.

The determination module 66 detects the image (belt image) of each first conveyor belt BL1 in the obtained image (step S3), and detects and measures the luminance of each belt image (step S4). At the same time, or subsequently, the determination module 66 detects the width of the belt image of each first conveyor belt BL1 (step S5).

Figure 8:
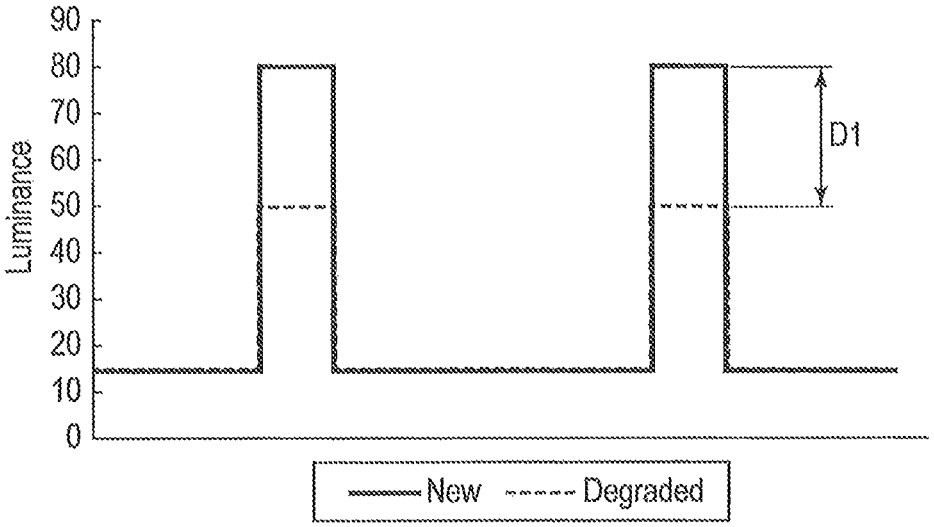
FIG. 8 shows the relationship between the belt images of the conveyor belts and luminance.
Figure 9:
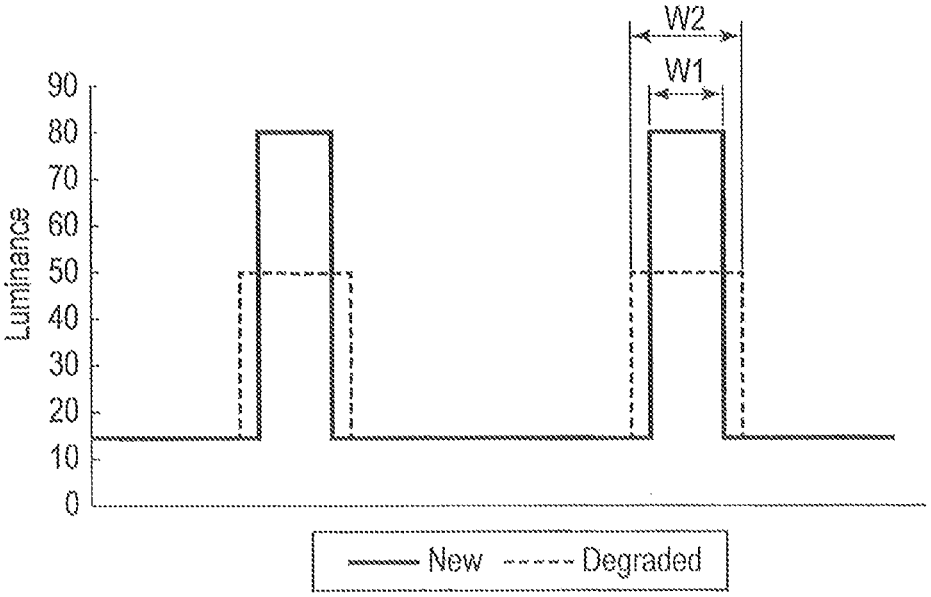
FIG. 9 shows the relationship between the gap width and the luminance of the belt images of conveyor belts.

FIG. 8 shows the relationship between the degradation level of the first conveyor belts BL1 and the luminance of belt images. FIG. 9 shows the relationship between the gap width in the width direction of the first conveyor belts BL1 and the luminance of belt images.

As shown in FIG. 8, as the degradation of the first conveyor belts BL1 is advanced due to unclearness, wear, stretch, etc., the luminance of a belt image changes. Specifically, the luminance is decreased. For example, the luminance of the belt image of a degraded first conveyor belt is less than the luminance of the belt image of a new first conveyor belt by approximately D1.

If the first conveyor belts BL1 are stretched due to degradation, a position gap is produced in a width direction when the belts are driven. Thus, as shown in FIG. 9, the width of a belt image is increased in connection with degradation. For example, width W2 of the belt image of a degraded first conveyor belt is greater than width W1 of the belt image of a new first conveyor belt (W<W1).

Figure 7:
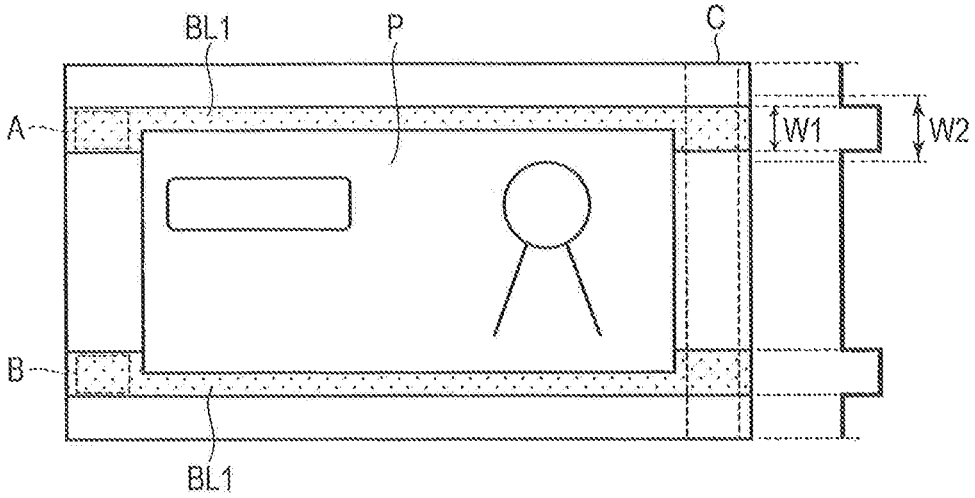
FIG. 7 is a plan view showing an example of the obtained image and detection areas.

FIG. 7 shows detection areas A, B and C detected by a belt image detection module 64 in an obtained image. When the luminance of each belt image is detected, the luminance of each belt image is detected by detecting detection areas A and B located on the first conveyor belts BL1. Alternatively, the belt image detection module 64 is capable of detecting the luminance of each belt image and the width of each belt image by detecting detection area C ranging over the whole width direction of the obtained image.

As shown in FIG. 5, the determination module 66 compares the measured luminance of each belt image with the predetermined first threshold A stored in the reference image memory 52 (step S6). When the measured luminance of a belt image is less than or equal to the first threshold A, the determination module 66 determines that the first conveyor belt BL1 is degraded, and transmits the result of determination to the control module 15. Accordingly, the control circuit 53 of the control module 15 transmits an alarm instruction to the alarm circuit 56. Based on the instruction, the alarm circuit 66 outputs a belt replacement instruction suggesting belt replacement (step 8). As the belt replacement instruction, various alarming methods may be adopted. For example, a belt replacement instruction may be displayed on the monitor 68 of the bill processing apparatus. An alarm lamp may be lighted. Alternatively, an alarm sound may be output.

After the belt replacement instruction is output, the belt image detection process is terminated. When the detected luminance is higher than the first threshold A in step S6, the process returns to step S1 and repeats the above steps.

The determination module 66 compares the detected width of each belt image with the predetermined second threshold B (for example, width W2) stored in the reference image memory 52 (step S7). When the detected width of a belt image is greater than or equal to the second threshold B, the determination module 66 determines that the first conveyor belt BL1 is degraded, and transmits the result of determination to the control module 15. Accordingly, the control circuit 53 of the control module 15 transmits an alarm instruction to the alarm circuit 56. Based on the instruction, the alarm circuit 56 outputs a belt replacement instruction suggesting belt replacement (step 8). After outputting the belt replacement instruction, the belt image detection process is terminated. When the detected width is less than the second threshold B in step S7, the process returns to step S1.

After belt replacement, the above belt image detection operation is performed regularly or as needed.

If the above belt image detection process is performed, the degradation level of the first conveyor belts BL1 can be detected, and thus, the appropriate time of replacement of the belts can be accurately determined. In this way, the use of a degraded conveyor belt can be prevented, thereby maintaining the stable conveyance of paper sheets and an accurate inspection process. As there is no need to regularly replace the conveyor belts, it is possible to prevent the replacement of a conveyor belt in which the degradation level is less, in other words, a conveyor belt which can be still used. Thus, the conveyor belts can be effectively used. Moreover, the degradation level of the conveyor belts can be determined without stopping the operation of the bill processing apparatus. Thus, the rate of operation of the bill processing apparatus is not decreased.

As described above, according to the present embodiment, it is possible to obtain a paper sheet processing apparatus and a paper sheet processing method capable of detecting the appropriate time of replacement of the structural members of the conveyance mechanism, maintaining the detection performance of the inspection device and improving the reliability.

The invention is not limited to the embodiment described above, and the constituent elements of the invention can be modified without departing from the spirit and scope of the invention. Various aspects of the invention can also be extracted from any appropriate combination of a plurality of constituent elements disclosed in tie embodiment. For example, some structural elements may be deleted from the structural elements disclosed in the embodiment. Furthermore, the constituent elements described in different embodiments may be arbitrarily combined.

In the above embodiment, both the luminance and width of a belt image are detected, and the degradation level of the belt is determined based on each result of detection. However, the structure is not limited to this example. The degradation level of a belt may be determined based on either one of the two.

As explained above, normally, in conveyor belts, the luminance of each image is decreased in connection with degradation. However, the top surface of a conveyor belt may be cut due to degradation depending on the type of the belt. Thus, light may be easily reflected. As a result, the luminance of its image may be increased in connection with degradation. If this type of conveyor belt is used, the degradation level of the conveyor belt may be detected by registering, for example, a third threshold A2 different from the first threshold in advance and determining whether or not the measured luminance is greater than or equal to the third threshold A2 in step S6 in FIG. 5.

The object whose degradation level should be detected is not limited to the first conveyor belts, and may be another structural member of the conveyance mechanism, such as a rubber roller (a looped roller thinner than the conveyor belts). The degradation level of each conveyor belt may not be necessarily detected based on the luminance and the gap width of a belt image. The degradation level may be determined by detecting another feature of each conveyor belt. For example, the scuffing states or the sizes of conveyor belts and rubber rollers are changed as the surfaces are worn. Thus, the degradation level may be determined by detecting the scuffing state from an obtained image. Alternatively, the degradation level may be determined by detecting the change of the size. The stretch of each conveyor belt, in other words, the degradation level, may be determined by adding a reference mark to the conveyor belt and detecting the timing of passage of the reference mark.

Moreover, in the above description, the degradation level of each conveyor belt is detected by using the information obtained by the first image detection device, in other words, an obtained image. However, the structure is not limited to this example. The degradation level of each conveyor belt or rubber roller may be detected by using the information obtained by another detection device, for example, the second image detection device, the transparent image detection device or the magnetic sensor.

The paper sheets to be processed are not limited to bills, and may be other paper sheets such as marketable securities.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper sheet processing apparatus comprising:

a conveyance device comprising a conveyor belt extending along a conveyance path and configured to convey a paper sheet by the conveyor belt; and an inspection device configured to inspect the paper sheet conveyed by the conveyor belt based on an image of the paper sheet;

the inspection device comprising:

an image detection device configured to capture an image of the paper sheet conveyed by the conveyor belt and an image of the conveyor belt and obtain an image of the paper sheet and the conveyor belt;

an image processing device configured to detect a degradation level of the conveyor belt based on a belt image of the conveyor belt in the obtained image; and a controller configured to transmit information encouraging replacement of the conveyor belt to a monitor mounted on or connected to the inspection device in accordance with the detected degradation level.

2. The paper sheet, processing apparatus of claim 1, wherein the image processing device comprises degradation level determination software for detecting luminance of the belt image and determining the degradation level of the conveyor belt based on the detected luminance.

3. The paper sheet processing apparatus of claim 2, wherein the image detection device comprises an illumination device which emits detection light to the conveyed paper sheet and the conveyor belt, and an image capture device configured to capture an image of reflected light on the paper sheet and the conveyor belt.

4. The paper sheet processing apparatus of claim 1, wherein the image processing device is configured to perform a process based on a degradation level determination software for detecting luminance of the belt image and determining the degradation level of the conveyor belt based on the detected luminance.

5. The paper sheet processing apparatus of claim 1, wherein the image processing device comprises degradation level determination software for detecting a width of the belt image and determining the degradation level of the conveyor belt based on the detected width.

6. The paper sheet processing apparatus of claim 1, wherein the image processing device is configured to perform a process based on a degradation level determination software for detecting a width of the belt image and determining the degradation level of the conveyor belt based on the detected width.

7. The paper sheet processing apparatus of claim 1, wherein the image detection device comprises an illumination device which emits detection light to the conveyed paper sheet and the conveyor belt, and an image capture device configured to capture an image of reflected light on the paper sheet and the conveyor belt.

8. The paper sheet processing apparatus of claim 7, wherein the conveyance device includes a pair of conveyor belts which are arranged in parallel with each other and the distance between them is slightly less than a width of the paper sheet, the image detection device comprises a reference plate provided under the pair of conveyor belts and to be substantially perpendicular to the pair of first conveyor belts, and the illumination device and image capture device are provided above the pair of conveyor belts.

9. The paper sheet processing apparatus of claim 1, wherein the image detection device comprises an illumination device which emits detection light to the conveyed paper sheet and the conveyor belt, and an image capture device configured to capture an image of reflected light on the paper sheet and the conveyor belt.

10. A paper sheet processing method comprising:

conveying a paper sheet via an inspection area by a conveyor belt;

capturing an image of the paper sheet which passes the inspection area and an image of the conveyor belt, and obtaining an image of the paper sheet and the conveyor belt;

inspecting the paper sheet based on the obtained image;

detecting a degradation level of the conveyor belt based on the belt image of the conveyor belt in the obtained image; and transmitting information encouraging replacement of the conveyor belt based on the detected degradation level.

11. The paper sheet processing method of claim 10, wherein the degradation level of the conveyor belt is detected by detecting luminance of the belt image, and the degradation level is determined based on the detected luminance.

12. The paper sheet processing method of claim 10, wherein the degradation level of the conveyor belt is detected by detecting a width of the belt image, and the degradation level is determined based on the detected width.

* * * * *